US005615496A

United States Patent [19]

Sharpstein

[11] Patent Number: 5,615,496

[45] Date of Patent: Apr. 1, 1997

[54] FLAT THONG

[76] Inventor: Sid Sharpstein, 19389 Waters Reach Trail #1102, Boca Raton, Fla. 33434

[21] Appl. No.: 560,936

[22] Filed: Nov. 20, 1995

Related U.S. Application Data

[63] Continuation of Ser. No. 251,480, May 31, 1994, abandoned.

[51] Int. Cl.[6] ..... A43B 3/12

[52] U.S. Cl. ..... 36/11.5; 36/94

[58] Field of Search ..... 36/11.5, 94, 8.1, 36/7.5

[56] References Cited

U.S. PATENT DOCUMENTS 4,030,212 6/1977 Ito ..... 36/11.5

4,864,736 9/1989 Bierk ..... 36/137

*Primary Examiner*—Ted Kavanaugh

*Attorney, Agent, or Firm*—McHale & Slavin, P.A.

[57] ABSTRACT

The instant invention is a one piece thong constructed from a flexible base. A cut line along the front of the base provides an upwardly extending tab for insertion between the first and second toe. The tab is shaped to conform to the toes and uses an enlarged upper portion for securing the base to the foot. A second cut disposed along the back of the base provides a flexible strap for securement around the heel of the foot. In the preferred use, the heel strap couples directly to the toe tab providing a slip-on thong by forming a strap that fits over the bridge of the foot.

4 Claims, 2 Drawing Sheets

FLAT THONG

This a continuation of application Ser. No. 251,480 filed on May 31, 1994 abandoned.

FIELD OF THE INVENTION

This invention relates generally to footwear and more particularly to an improved thong having integrated toe and heel securement.

BACKGROUND INFORMATION

Footwear has been used throughout the ages to protect a person's foot while walking. Footwear protection is now required by modern societies causing the sole of a person's feet to become soft and easily injured should one decide to walk barefoot. For this reason most people now rely on the protection and traction provided by footwear even in situations where walking barefoot is permissible.

For instance, while a visit to a beach is an ideal place to walk barefoot, everyone has experienced the pain of stepping on a sharp rock, hot sand, or running across hot pavement. The end result is typically injury to the sole of the foot. Persons bathing are susceptible to injury due from slipping and falling on a wet surface, such as a bathtub or shower, since bare feet do not provide the traction of conventional footwear. Hardly a day goes by without hearing about an elderly person who has fallen while taking a bath or shower due to slippery surfaces.

Bodily injury is not the only reason for wearing footwear. It is well known that athletes can withstand a fall without injury. However in many instances walking barefoot can lead to another form of injury. For instance, in team sports the athletes use the same shower room wherein fellow bathers may spread waterborne fungus such as athletes feet or the like.

Even sterile environments require foot protection. Hospitals are required by insurance carriers to provide patients with footwear. This typically is nothing more than a cloth sock which can be more slippery than had the patient gone barefoot. If the socks are fitted with a non-slip surface it adds to the cost of manufacture yet cannot be worn in a shower or reused.

The thong is one type of footwear used to address the aforementioned problems. Dating back centuries, a thong is basically footwear having a base that is secured to the sole of the foot. Attachment to the foot is typically maintained by a toe or bridge strap. If the thong relies only upon a toe strap, then the thong will "clap" when the wearer walks since the heel is not attached.

A problem with the conventional thong is the manner in which the attaching strap is secured to the base of the thong. A separate strap such as leather that is sewn to the base adds an expense to the manufacture of the thong and can pull loose from the base if the attachment becomes wet.

A thong having an attachment strap made of rubber must be glued or otherwise integrated into the base. This is also an expensive manufacturing process that requires modification of the base for acceptance. Further, if the manufacturing costs of the conventional thong could be reduced, the lack of heel support is not acceptable for instances in which traction is necessary.

Thus, what is needed in the art is an inexpensive footwear device having the simplicity of a disposable thong and an improved strap attachment that eliminates sewing, gluing or the like attachments.

SUMMARY OF THE INVENTION

The present invention satisfies this need through provision of a one piece thong that locks into position for use as a slip-on thong or alternatively provides securement to both the toe and heel of the foot.

The invention consists of a flexible base allowing flat storage wherein strategically placed cut lines permit use as either a modified thong or sandal. A cut line disposed along the front of the base provides an upwardly extending toe tab for insertion between the wearer's first and second toes. The tab is shaped to conform to the toes and employs an enlarged upper portion for coupling to a strap formed by a second cut line disposed at the rear of the base. In the preferred embodiment, the strap is folded to engage the toe tab which fits within an insertion hole placed in the strap. The strap provides securement around the bridge of the foot allowing the wearer to slide their foot into and out of the thong. The strap remains flexible allowing the thong to accommodate a large range of foot sizes. For storage, the toe tab can be removed from the insertion hole allowing the base to return to its original flat position. In an alternative embodiment, the heel strap is used in a conventional manner where the toe tab is inserted between the wearer's and the heel strap is hooked over the achilles tendon.

The thong of the instant invention is constructed from a single piece of material which may include multiple layers to provide various comfort levels. A single piece of rubber provides a low cost thong that can be sterilized repeatedly for use in hospitals and locker rooms. A soft piece of foam material may be bonded to a rubberized base providing a cushion walking surface on top of a base having superior traction. Materials or layers can be added having color so that the thong provides fashionable footwear.

Thus, a primary objective of the instant invention is to provide an inexpensive footwear device that is stored or shipped in a flat position and available for use as a slip-on thong capable of accommodating a large range of foot sizes.

Another objective is to provide a single piece thong having an alternative use engaging both the toe and heel of a foot.

Still another objective is to provide a thong that is cut from a single piece of material which may include multiple layers of material providing an upper surface that is cushioned for the sole of the foot and a lower surface that provides superior wear and slip resistance.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Although the invention has been described in terms a specific embodiment, it will be readily apparent to those skilled in this art that various modifications, rearrangements and substitutions can be made without departing from the spirit of the invention. The scope of the invention is defined by the claims appended hereto.

Figure 1:
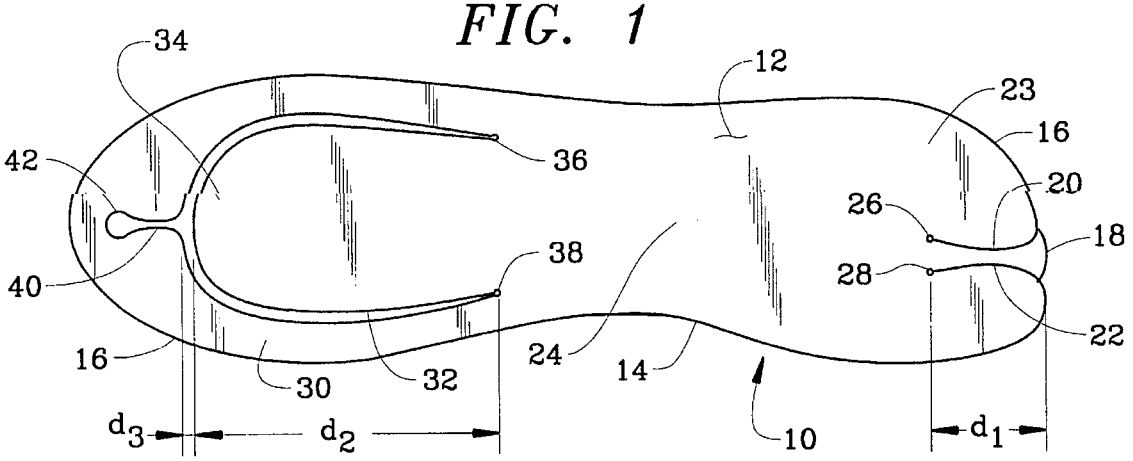
FIG. 1 is a top view of the thong illustrating the cut lines.

Now referring to FIG. 1, shown is the thong 10 of the instant invention which is constructed from at least one piece of flexible material such as rubber, ethylene vinyl acetate or a similar material. Preferably a low density foam is used providing a soft upper surface 12 and a high density rubber is used to provide lower surface 14 capable of wear resistance. The perimeter 16 of the thong base defines an edge shaped to accommodate the sole of a human foot. A toe tab 18 is formed by a first cut line 20 and second cut line 22 beginning at a toe section 23 of said base connecting said upper surface 12 and lower surface 14 and extending inwardly toward a middle section 24 a first predetermined distance $d_1$ of approximately 35 mm to 45 mm. Each cut line ends in circular holes 26, 28 to prevent tearing. The toe section 23 has a unique ornamental shape depicting toe curvature of a human foot. Further, the end of the toe section 23 is mushroomed so as to engage a heel strap in a preferred embodiment or hook over the top of the toes in an alternative embodiment.

The heel strap 30 is formed from a U-shaped cut line 32 connecting the upper surface 12 and lower surface 14 and is placed inboard from the perimeter edge along a heel portion 34 of the base extending toward the middle section 24 a predetermined distance $d_2$ between 90 mm and 100 mm and ending in circular holes 36 and 38 to prevent tearing. The cut line is enlarged between 1 mm to 10 mm for ease of foot insertion.

In the preferred embodiment, through hole 42 is located at the end of cut line 32 and used for coupling the toe tab 18 upon folding of the heel strap 30 to the toe tab 18. A centrally disposed cut line 40 extending outwardly from said cut line 32 allows for the slidable insertion of the toe tab 18 for ease of engaging through hole 42. The thong is thus placed in a form allowing for the slidable insertion of a human foot, the body of the toe tab 18 being inserted between the first and second toes of the wearer's foot.

Figure 2:
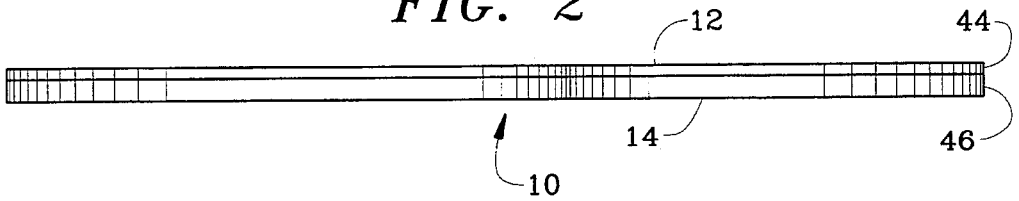
FIG. 2 is a side view of FIG. 1.

Referring to FIG. 2, the thong can be constructed from a single piece of material or more preferably, from a first piece of material 44 such as foam rubber providing a cushioned upper surface 12. The first layer of material 44 is permanently bonded to a second layer 46 of material such as high density rubber to provide abrasion resistance. The lower surface 14 of the second layer 46 can be altered to provide traction over a wide variety of surfaces.

Figure 3:
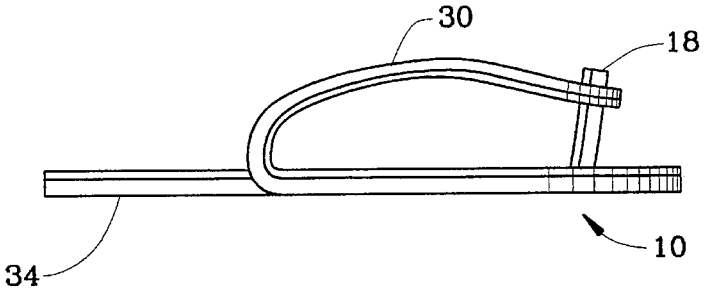
FIG. 3 is a side view of FIG. 1 illustrating the preferred use of the device wherein the toe tab and heel strap are coupled together.
Figure 4:
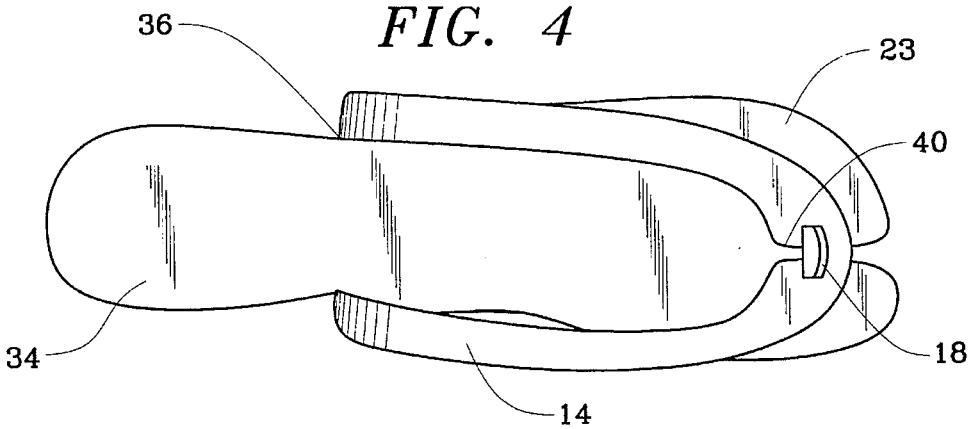
FIG. 4 is a top view of FIG. 3.
Figure 5:
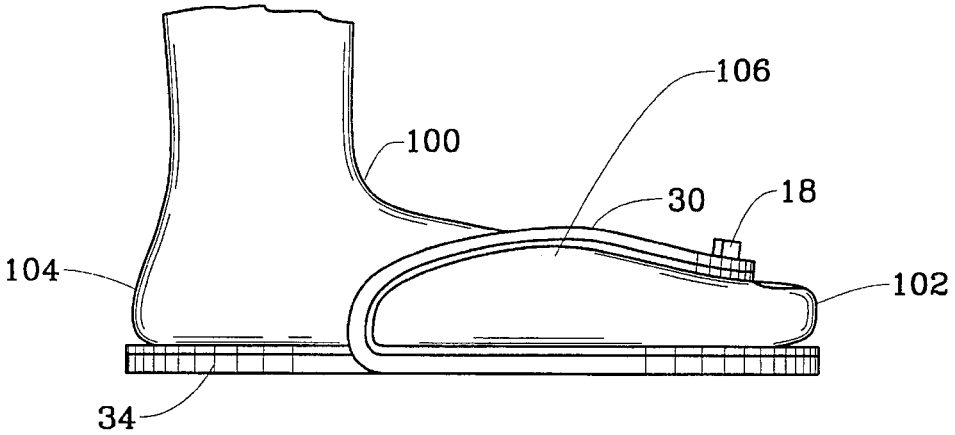
FIG. 5 is a pictorial side view of the instant invention in its preferred use when placed on a foot.

FIGS. 3 through 5 illustrate the preferred use of the thong providing slidable attachment to the foot. In this embodiment the thong is depicted with a raised toe tab 18 coupled to heel strap 30. In forming the configuration, the toe tab 18 is inserted into through hole 42 by folding the heel strap 16 toward the front of the thong so as to slide the side walls 20, 22 of toe tab 18 through slot 40 to engage the lower surface of the heel strap with the underside of the toe tab 18. It should be noted that heel strap 16 is inverted providing the thong with an alternative color to the strap.

Referring in particular to FIG. 5, the pictorial view of a human foot 100 inserted into the device as formed in Figures 3 and 4 illustrate the preferred use wherein the toe piece extends slightly above the toes 102 for engaging heel strap 30. In this embodiment the heel strap 30 provides securement for the bridge 106 of the foot allowing the foot to be easily inserted from the rear of the device. Thus, upon coupling the toe tab 18 to the heel strap 30 the combination provides a flexible opening for insertion of the foot 100. Upon removal of the foot, the heel strap 16 can be removed from its coupled connection to the toe tab 18 wherein the thong 10 returns to a flat position suitable for storage.

Figure 6:
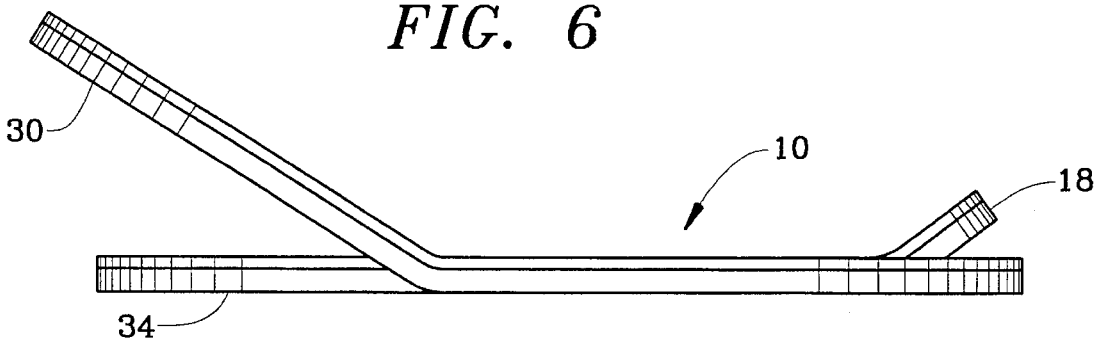
FIG. 6 is a side view of FIG. 1 illustrating an alternative use of the device wherein the toe tab and heel strap are used separately.
Figure 7:
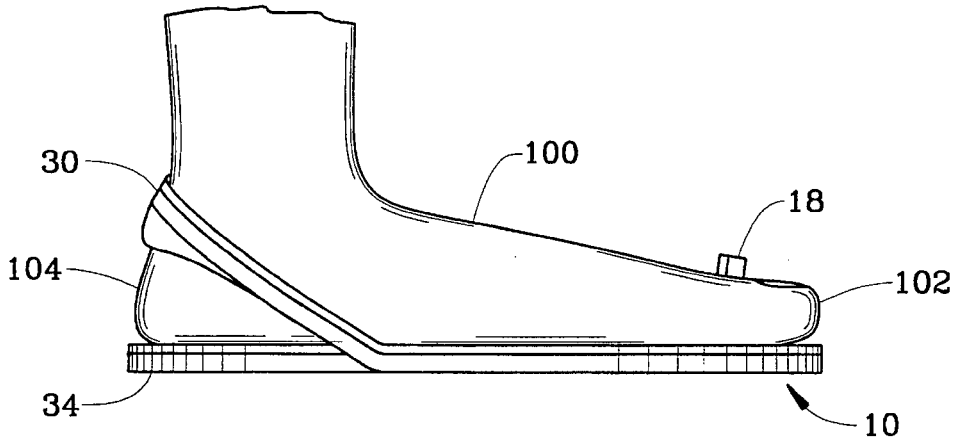
FIG. 7 is a pictorial side view of the instant invention wherein the alternative use of the thong is illustrated wherein the toe tab and heel strap are used separately.

FIGS. 6 and 7 illustrate an alternative use of the thong providing attachment to the heel of a foot. In this embodiment the thong is depicted with a raised toe tab 18 and heel strap 30. The foot 100 is inserted into the device wherein the toe tab 18 extends above the foot allowing securement by means of the toes 102. The heel strap 30 is then placed over the heel 104 of the foot 100 deforming slightly to accommodate the tendon. The heel 104 positions directly over the heel portion 34 of the device providing protection of the sole of the foot from the toe to heel. The heel strap is enlarged so as to provide an area to grasp thereby assisting foot insertion when using the heel strap.

It is to be understood that while I have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What is claimed is:

1. An improved thong characterized by a base having an outer perimeter edge shaped to accommodate the heel and toes of a human foot, said base having a toe tab for insertion between the first and second toe and a heel strap being of such configuration as to cooperatively secure to said toe tab, the improvement comprising:

a base constructed from a first sheet of low density foam rubber material bonded to a second sheet constructed from high density foam rubber material forming an upper surface and a lower surface, said first sheet providing a cushioned walking surface and said second sheet providing abrasion resistance and traction on slippery ground surfaces, a toe tab shaped like a human toe and formed integral to said base, said toe tab defined by a space apart first and second cut line connecting said upper and lower surface, each cut line extending inwardly approximately 40 mm from said outer perimeter edge toward a middle section a first distance terminating in a circular hole along a distal end forming a flexible hinge allowing said toe tab to lay flat or bend upwardly, said heel strap formed integral to said base defined by a U-shaped opening connecting said upper and lower surface placed inboard said perimeter edge along a heel portion of said base and extending toward said middle section approximately 95 mm, said opening separating said heel portion from said heel strap a fixed distance with a first and second end of said opening terminating in a circular hole and a heel cutout placed in said heel strap along an edge of said U-shaped opening, said heel cutout having a shape and width to accommodate the tendon of a human foot with said cutout extending outwardly from said U-shaped opening leading to a centrally disposed tear drop shaped coupling hole;

whereby said heel cutout allows for securing said heel strap to said toe tab or securing said heel strap to the heel of a wearer with said cutout having a shape accommodating the tendon of a human's foot.

2. The improved thong according to claim 1 wherein said U-shaped cut line provides a spacing of approximately 10 mm between said heel portion and said heel strap to accommodate the heel tendon when worn as a thong.

3. The improved thong according to claim 1 wherein said coupling hole is operatively associated with said toe tab forming said thong into a sandal.

4. The improved thong according to claim 1 wherein one of said sheets is constructed of EVA.

* * * * *